United States Patent [19]

Tschan et al.

[11] 4,387,543

[45] Jun. 14, 1983

[54] ANCHOR BRACKET

[75] Inventors: J. Donald Tschan, Bellevue; Clifford P. Hatton, Seattle, both of Wash.

[73] Assignee: P. H. Bowman Co., Inc., Seattle, Wash.

[21] Appl. No.: 231,630

[22] Filed: Feb. 5, 1981

[51] Int. Cl.[3] ..... E04C 5/18; E04B 1/38; E02D 27/00

[52] U.S. Cl. ..... 52/295; 52/704; 52/707

[58] Field of Search ..... 52/295–297, 52/712–715, 365, 370, 704–707

[56] References Cited

U.S. PATENT DOCUMENTS

| | | | |
|---|---|---|---|
| 919,771 | 4/1909 | Roberts | 52/296 |
| 2,110,863 | 3/1938 | Barnett | 52/704 |
| 2,227,713 | 1/1941 | Higgins | 52/704 |

FOREIGN PATENT DOCUMENTS

| | | | |
|---|---|---|---|
| 103929 | 5/1938 | Australia | 52/370 |
| 2325483 | 12/1974 | Fed. Rep. of Germany | 52/707 |

OTHER PUBLICATIONS

Exhibit 1: portion of p. 18 of catalog distributed by P. H. Bowman Co., Inc., Seattle, Wash.

Exhibit 2: p. 5 of advertising brochure distributed by Simpson Company.

*Primary Examiner*—James L. Ridgill, Jr.

*Attorney, Agent, or Firm*—John O. Graybeal

[57] ABSTRACT

An anchor bracket (10) for supporting the lower end of a vertical column (12) spaced slightly above a concrete bed (14) includes an upper, channel-shaped section (16) for receiving the lower end of column (12). Anchor bracket (10) also includes an elongate, upright, post section (18) extending downwardly from channel section (16) into concrete (14). A flat, relatively thin necked-down portion (34) is formed intermediate the ends of post section (18) to serve as a reaction member reacting against concrete (14) to thereby prevent anchor bracket (10) from rotating about or moving longitudinally along the length of post section (18).

4 Claims, 9 Drawing Figures

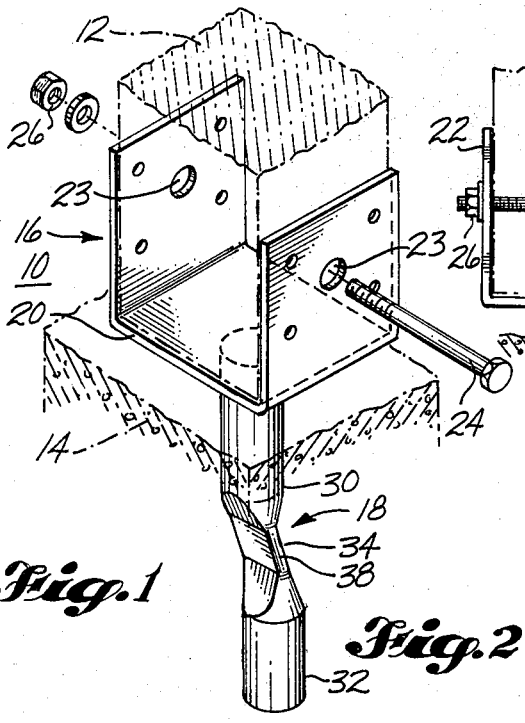
Fig. 1
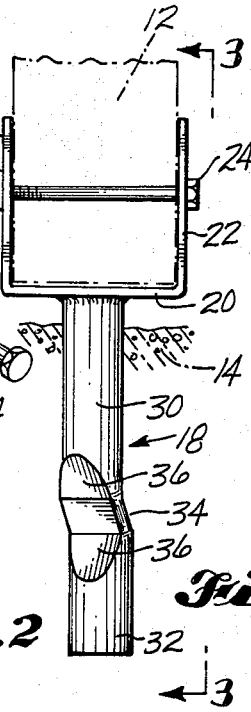
Fig. 2
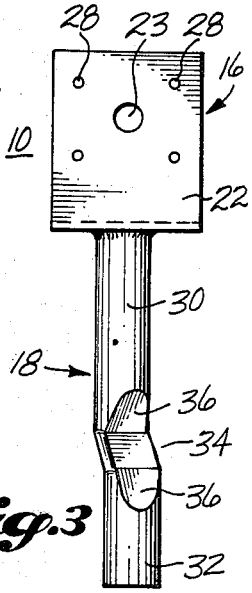
Fig. 3
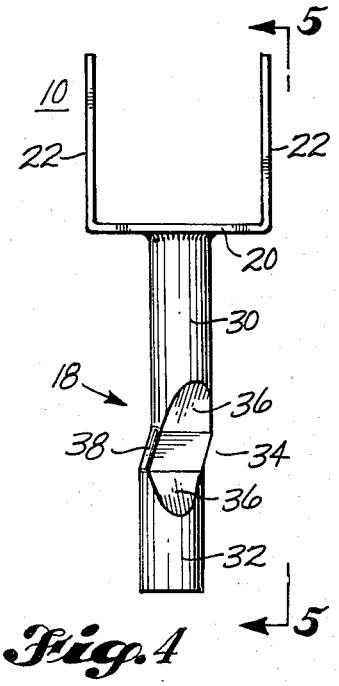
Fig. 4
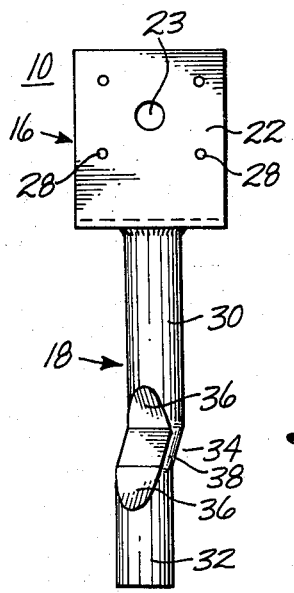
Fig. 5
Fig. 6
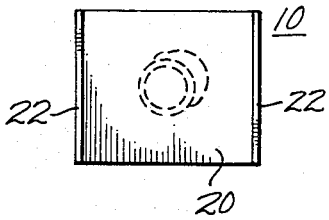
Fig. 7
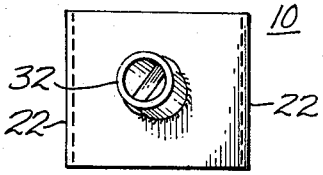

ANCHOR BRACKET

DESCRIPTION

1. Technical Field

The present invention relates to column anchor brackets, and more particularly to such brackets as used in the building construction trade for anchoring the lower end of a column or post in a bed of concrete while supporting the bottom of the column or post spaced slightly above the concrete.

2. Background Art

Rather than setting the lower end of a wooden load-bearing column directly into or on top of a base member such as a concrete pad, it is desirable in construction practice to space the bottom of the column above the concrete pad to prevent premature rotting of the post from moisture absorbed from the concrete. Several types of brackets have been developed for the purpose and one type of such bracket includes an upper section composed of a U-shaped member for receiving and vertically supporting the lower end portion of a column. An elongate, straight post member extends downwardly from the underside of the web portion of the U-shaped member to embed within the underlying concrete. The web portion of the U-shaped section, and thus the bottom of the column itself, is spaced slightly above the concrete. One problem of this particular design is that the post portion of the bracket offers very little resistance to axial movement of the bracket especially in the direction upwardly out of the concrete. As a consequence, if the bracket is sufficiently loaded in the upward direction, it is possible for the bracket to actually withdraw out of the concrete bed.

A column anchor bracket constructed similarly to the one described above has been manufactured by applicants' assignee, the P. H. Bowman Company, Inc. of Seattle, Washington. However, the Bowman bracket includes an additional member in the form of a short cylindrical rod attached to and extending transversely of the post portion of the bracket at an elevation below the upper surface of the concrete. The additional transverse member was added for the purpose of increasing the resistance of the bracket against rotation about and translation along the longitudinal axis of the bracket in the concrete. Oftentimes workmen place anchor brackets into concrete a fairly long length of time after the concrete has been poured, i.e. when the concrete is firm enough to support the bracket by itself. Thus, when the bracket is plunged into the concrete, a void is often created in the portion of the concrete disposed above the transverse member. As a result, the emplaced bracket often has very little resistance to upward withdrawal.

In a further type of known anchor bracket constructed similarly to those discussed above, the post portion of the bracket is constructed from a hollow cylindrical member. A diametrically opposed, longitudinally extending slit is formed in the lower end portion of the cylindrical member and then the sides of the slit portion of the cylindrical member are turned or curled outwardly to extend transversely in opposite directions from the lower end portion of the post. Although forming the anchor bracket in this manner increases the surface area of the post in the longitudinal direction thereof to thereby theoretically increase the resistance of the bracket against shifting up or down, the possibility of creating a void in the concrete at locations above the curled ends of the bracket when embedded within concrete is also greatly enhanced. As a consequence, the bracket may in fact exhibit less resistance to upward withdrawal from the concrete than if the post was formed without a curled lower end portion.

DISCLOSURE OF THE INVENTION

The present invention relates to a bracket for supporting the lower end portion of a post or column member a short distance above a bed of concrete material to thereby fixedly anchor the column and prevent moisture in or on the concrete from reaching the column. The anchor bracket includes a channel-shaped upper end section for receiving the bottom portion of the structural column which fits between the two upwardly extending flanges of the bracket channel-shapedsection. The bottom of the column rests on the web of the channel-shaped section.

The bracket further includes an elongate, hollow, cylindrical post section fixedly attached to and extending downwardly from the underside of the channel web. The post section includes a flat, relatively thin, necked-down portion located intermediate the ends of the post. The necked-down portion is ideally formed by crimping the post in such a manner that each end of the necked-down portion transitions smoothly with the adjacent portion of the post so that no abrupt changes in curvature exist. In side edge elevation, the necked-down portion is disposed diagonally to the height of the post so that the portion of the post disposed below the necked-down portion is offset transversely from the portion of the post disposed above the necked-down portion. Forming the necked-down portion of the post in this manner creates a generally upright, planar, flat surface to thereby resist rotation of the bracket about the longitudinal axis of the post within the concrete. Moreover, the concrete which occupies the space adjacent the necked-down portion of the post reacts against the adjacent portions of the post disposed above and below the necked-down portion to thereby prevent axial movement of the post. The smooth transitions between the necked-down portion and the upper and lower portions of the post prevent voids from occurring in the concrete as the post is embedded into partially set up concrete. As a result, the bracket of the present invention resists upward withdrawal from the concrete as effectively as it resists downward shifting.

BRIEF DESCRIPTION OF THE DRAWINGS

The details of one typical embodiment of the present invention will be described in connection with the accompanying drawings, in which:

FIG. 1 is an isometric view of an anchor bracket constructed according to the present invention as viewed toward the front and right side of the bracket;

FIG. 2 is a front elevation view of the bracket illustrated in FIG. 1;

FIG. 3 is a right side elevational view of the bracket illustrated in FIGS. 1 and 2 as viewed along lines 3—3 of FIG. 2;

FIG. 4 is a rear elevational view of the bracket shown in FIGS. 1–3;

FIG. 5 is a left side elevational view of the bracket shown in FIGS. 1–4, as viewed along lines 5—5 of FIG. 4;

FIG. 6 is a top view of the bracket shown in FIGS. 1–5, specifically looking downwardly in FIG. 2;

FIG. 7 is a bottom view of the bracket shown in FIGS. 1–6, specifically looking upwardly in FIG. 2;

BEST MODE OF THE PRESENT INVENTION

Figure 8:
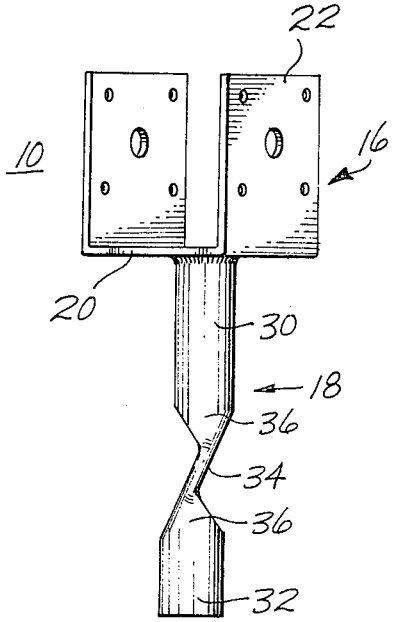
FIG. 8 is an elevational view of the bracket shown in FIGS. 1–7, with the bracket rotated so that the necked-down portion is shown in side elevation.
Figure 9:
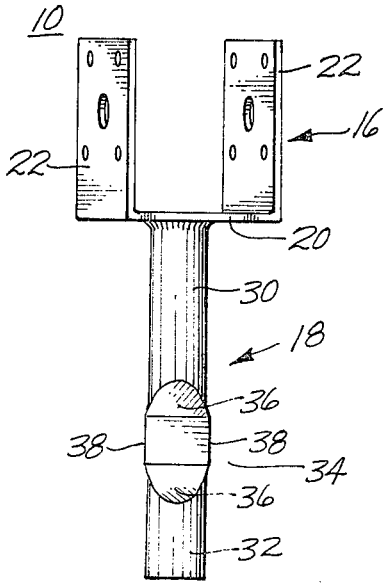
FIG. 9 is an elevational view of the bracket shown in FIGS. 1–8, with the bracket rotated so that the necked-down portion is illustrated in front elevation.

Referring initially to FIGS. 1 and 2, an anchor bracket 10 constructed according to the best mode of the present invention currently known to applicants is illustrated as supporting the lower end of a post or column 12 spaced slightly above a bed of concrete 14. Bracket 10 basically includes a channel-shaped upper section 16 and an elongate, downwardly extending lower, post section 18. Typically, anchor bracket 10 is installed by pressing post section 18 downwardly into concrete 14 after the newly poured concrete has partially cured so that the concrete is capable of supporting bracket 10 per se in upright orientation without the need for additional bracing. After the concrete has fully cured, the lower end of column 12 is placed within channel section 16.

Additionally referring to FIGS. 3–5, channel section 16 is illustrated as including a flat, relatively thin, rectangularly shaped web 20 underlying and upwardly supporting the bottom of column 12. A pair of planar, spaced flanges 22 extend upwardly from each side of web 20 to closely overlie opposite sides of column 12. Aligned through holes 23 are centrally formed within flanges 22 to receive bolt 24 which also extends through an aligned hole formed in column 12 to thereby securely join the lower end of the column with channel section 16. A nut 26 is engaged with the threaded free end of bolt 24 to prevent the bolt from retracting from channel section 16. Alternatively, column 12 may be secured to channel section 16 by nails or similar types of hardware, not shown, which extend through the four smaller holes 28 formed in flanges 22 and disposed about larger hole 23.

Additionally referring to FIGS. 6–8, bracket 10 includes an elongate, upright post section 18 extending downwardly from channel section 16 into the concrete 14. Post section 18 includes a circular, upper portion 30 fixedly attached to a central portion of the underside of channel web 20, for instance by weldment. Post section 18 further includes a lower portion 32 which is separated from upper portion 30 by a necked-down portion 34. Necked-down portion 34 is generally rectangular and planar, having a thickness which is substantially less than the diameter of the post upper and lower portions. As best illustrated in FIG. 8, rather than being disposed in a vertical plane in alignment with the length of post section 18, necked-down portion 34 is disposed diagonally to the post upper and lower portions 30 and 32. As a consequence, post lower portion 32 is offset from post upper portion 30 by an amount approximately one-half of the diameter of post section 18. This offset further effectively increases the resistance of the embedded bracket as against rotation of the bracket in the fully cured concrete. Also, when viewing bracket 10 along the length of post section 18 as shown in FIG. 7, the plane defined by necked-down portion 34 is not aligned parallel with or disposed perpendicularly to the planes defined by channel section flanges 22; rather, post section 18, as illustrated in FIGS. 1 and 7, is rotated about its longitudinal axis relative to channel section 16 so that one side edge of necked-down portion 34 is directed toward the right front corner of channel section 16. However, applicants have not found that the particular alignment of necked-down portion 34 has any particular effect on the resistance 10 to rotate about the length of post section 18 or to withdraw from concrete 14. Accordingly, post section 18 need not be affixed to bracket 10 at any specific alignment of necked down portion 34.

Referring to FIGS. 1–5 and 8, post necked-down portion 34 is formed at a location generally centrally along the length of post 18 to ensure that the necked-down portion is embedded within concrete 14. Necked-down portion 34 is interconnected with post upper and lower portions 30 and 32 by transition portions 36 which smoothly merge the planar, necked-down portion with the circular, post upper and lower portions. When post 18 is placed in partially cured concrete 14, the smooth transition portions 36 make it possible for concrete to completely fill in around necked-down portion 34 rather than leaving a void in this region which might occur if transition portions 36 were not utilized. The concrete filling in around necked-down portion 34 not only prevents bracket 10 from rotating about the longitudinal axis of post 18, but also retains the bracket against moving up or down within the concrete by reacting upwardly and downwardly against transition portions 36. Bracket 10 is further anchored against movement in the vertical direction by the fact that post lower portion 32 is offset from post upper portion 30, FIGS. 6–8.

Ideally, post section 18 is constructed from a hollow, cylindrical member thereby enabling necked-down portion 34 to be conveniently formed simply by crimping the central portion of the post section by the use of, for instance, a press. The hollow construction of post section 18 enables the post to be flattened into a relatively thin necked-down portion 34 while also resulting in smoothly formed transition portions 36. If post section 18 were produced from a solid bar, formation of necked-down portion 34 and transition portions 36 would require the removal of a considerable quantity of material, for instance by grinding, machining, or burning, which processes are significantly more time-consuming and expensive than the operation of simply crimping a hollow cylindrical member in the manner described above. Also, by forming necked-down portion 34 by crimping hollow cylindrical post 18, the side edges 38 of the necked-down portion extend beyond the outside diameter of upper and lower post portions 30 and 32 to form protrusions which react against the adjacent portions of concrete 14 to additionally assist in preventing longitudinal movement of bracket 10. An additional advantage of forming post section 18 from a hollow member is that concrete 14 can occupy the interior of post lower portion 32 thereby further securing post section 18 within the concrete.

Although post section 18 is illustrated as cylindrical, it can be formed in other shapes, such as square, rectangular or hexagonal in cross-section. Forming post section 18 in these alternative shapes provides flat exterior surfaces which can react against the concrete to prevent the posts from rotating about its longitudinal axis.

As will be apparent to those skilled in the art to which the invention is addressed, the present invention may be embodied in forms or embodiments other than that specifically disclosed above, without departing from the spirit or essential characteristics of the invention.

The particular embodiment of the anchor bracket 10 described above, is therefore to be considered in all respects as illustrative and not restrictive, i.e. the scope of the present invention is set forth in the appended claims rather than being limited to the example of anchor bracket 10 as set forth in the foregoing description.

What is claimed is:

1. A bracket for anchoring a column member in a bed of concrete and supporting the bottom of the member slightly above the concrete, comprising:

a channel shaped upper section with parallel, upwardly extending flanges adapted to be attached to the member to be anchored; and an elongate lower post section joined to and extending downwardly from substantially the center of said upper section and of generally hollow tubular form with a substantially uniform wall thickness throughout, the upper portion of said post section being centered about a vertical axis substantially coincident with the center of said upper section, and the lower portion of said post section being centered about a vertical axis substantially parallel to and offset from the vertical axis of the post upper portion by an amount approximately one-half the diameter of the post section, said upper and lower post sections being joined by a generally central portion formed by flattening together opposed wall portions of the post section, such central portion as thus formed being characterized by the flattened wall portions being parallel and contiguous to each other and non-parallel to the axes of the upper and lower portions of said post section.

2. A bracket according to claim 1, wherein said opposed wall portions are substantially rectangular, said upper and lower post portions are substantially circular in cross-section, and said wall portions with said upper and lower post portions are interconnected by smoothly curving transition portions.

3. A bracket according to claim 1, wherein the bracket upper section includes a central web engageable with the bottom of the column member with the said parallel, upwardly extending flanges arranged at opposite sides thereof, and wherein the faces of said central section flattened wall portions are disposed in planes rotated relative to the planes of said flanges about an axis parallel to the axes of said post section upper and lower portions.

4. A bracket according to claim 3, wherein said opposed wall portions are substantially rectangular, said upper and lower post portions are substantially circular in cross-section, and said wall portions with said upper and lower post portions are interconnected by smoothly curving transition portions.

* * * * *